US010049810B2

(12) United States Patent
Jacobson

(10) Patent No.: US 10,049,810 B2
(45) Date of Patent: Aug. 14, 2018

(54) HIGH VOLTAGE HIGH FREQUENCY TRANSFORMER

(71) Applicant: Raytheon Company, Waltham, MA (US)

(72) Inventor: Boris S. Jacobson, Westford, MA (US)

(73) Assignee: RAYTHEON COMPANY, Waltham, MA (US)

( * ) Notice: Subject to any disclaimer, the term of this patent is extended or adjusted under 35 U.S.C. 154(b) by 0 days.

(21) Appl. No.: 14/935,608

(22) Filed: Nov. 9, 2015

(65) Prior Publication Data

US 2017/0133151 A1 May 11, 2017

(51) Int. Cl.

| | |
|---|---|
| ***H01F 27/32*** | (2006.01) |
| ***H01F 7/06*** | (2006.01) |
| ***H01F 27/36*** | (2006.01) |
| ***H01F 27/28*** | (2006.01) |
| ***H01F 27/02*** | (2006.01) |
| ***H01F 41/04*** | (2006.01) |

(52) U.S. Cl.

CPC ..... *H01F 27/365* (2013.01); *H01F 27/02* (2013.01); *H01F 27/2804* (2013.01); *H01F 27/362* (2013.01); *H01F 41/041* (2013.01)

(58) Field of Classification Search

CPC ..... H01F 27/36; H01F 27/28; H01F 27/02; H01F 27/362; H01F 2017/008; H01F 41/04; H01F 27/365; H01F 41/041

USPC ..... 336/84 C, 221, 170; 29/602.1; 363/40, 363/131, 20

See application file for complete search history.

(56) References Cited

U.S. PATENT DOCUMENTS

| | | | |
|---|---|---|---|
| 4,942,353 | A | 7/1990 | Herbert |
| 4,977,301 | A | 12/1990 | Maehara |
| 4,978,906 | A | 12/1990 | Herbert |
| 5,312,674 | A | 5/1994 | Haertling |
| 5,745,981 | A | 5/1998 | Roshen |
| 5,777,539 | A | 7/1998 | Folker |
| 5,959,522 | A | 9/1999 | Andrews |
| 5,973,923 | A | 10/1999 | Jitaru |
| 5,990,776 | A | 11/1999 | Jitaru |
| 5,999,078 | A | 12/1999 | Herbert |
| 6,445,272 | B1 | 9/2002 | Mercado |
| 6,628,531 | B2 | 9/2003 | Dadafshar |
| 6,727,793 | B2 | 4/2004 | Piechnick |
| 6,820,321 | B2 | 11/2004 | Harding |

(Continued)

FOREIGN PATENT DOCUMENTS

WO 0025141 A1 5/2000

OTHER PUBLICATIONS

B. Jacobson, et al, "Planar Integrated Magnetics Assembly for High Voltage Converters", IEEE APEC, 2000, pp. 627-632, 6 pages.

*Primary Examiner* — Mangtin Lian

(74) *Attorney, Agent, or Firm* — Cantor Colburn LLP

(57) ABSTRACT

A transformer includes a core having a central arm and first and second outer arms on opposite sides of the of the central arm, a first input winding surrounding the central arm and a first output winding surrounding the central arm. The transformer also includes a first input winding shield surrounding the first input winding, the first input winding shield having only flat or arcuate edges in cross section and a first output winding shield surrounding the first output winding, the first output winding shield having only flat or arcuate edges in cross section.

23 Claims, 8 Drawing Sheets

(56) References Cited

U.S. PATENT DOCUMENTS

| | | | | |
|---|---|---|---|---|
| 6,847,284 | B2 | 1/2005 | Gamou | |
| 7,084,728 | B2 | 8/2006 | Hyvonen | |
| 7,187,263 | B2 | 3/2007 | Vinciarelli | |
| 7,248,138 | B2 | 7/2007 | Chiang | |
| 7,262,680 | B2 | 8/2007 | Wang | |
| 7,304,862 | B2 | 12/2007 | Busletta | |
| 7,361,847 | B2 | 4/2008 | Dunn | |
| 7,382,219 | B1 | 6/2008 | Lee | |
| 7,477,120 | B2 * | 1/2009 | Gu | H01F 27/367 336/84 C |
| 8,089,331 | B2 | 1/2012 | Jacobson | |
| 8,593,245 | B2 * | 11/2013 | Zeng | H01F 27/2885 336/200 |
| 2002/0039062 | A1 | 4/2002 | Kvarnsjo | |
| 2003/0095026 | A1 | 5/2003 | Kawanobe | |
| 2004/0032313 | A1 | 2/2004 | Ferencz | |
| 2004/0240126 | A1 | 12/2004 | Tiemeijer | |
| 2006/0232301 | A1 | 10/2006 | Morlion et al. | |
| 2006/0267718 | A1 | 11/2006 | Salama et al. | |
| 2007/0018334 | A1 | 1/2007 | Peytavy et al. | |
| 2007/0217168 | A1 | 9/2007 | Masuyama et al. | |
| 2008/0007249 | A1 | 1/2008 | Wilkerson et al. | |
| 2008/0094166 | A1 | 4/2008 | Hsu et al. | |
| 2009/0115564 | A1 | 5/2009 | Minteer et al. | |
| 2009/0189725 | A1 | 7/2009 | Ding et al. | |
| 2014/0139313 | A1 * | 5/2014 | Zhou | B65H 75/14 336/84 C |
| 2014/0347158 | A1 * | 11/2014 | Goeke | H01F 27/362 336/84 C |

* cited by examiner

HIGH VOLTAGE HIGH FREQUENCY TRANSFORMER

BACKGROUND

The present invention relates to providing power and, more specifically, to providing a compact, high-voltage, high-frequency transformer to provide power.

Power converters are used to convert power from an input to a needed power for provision to a load. One type of power converter is a transformer. Transformers may be designed to convert a fixed AC input voltage into a higher or lower AC voltage. The architecture chosen may provide for high frequency operation, pulse-width-modulation, isolation, and the like.

Different types of transformers may be used depending on a particular application. A typical power transformer includes one or more input windings and one or more output windings. The input and output coils are both wrapped around a core formed of a magnetic material. An alternating current provided at the input (e.g., primary) windings causes a varying magnetic flux in the transformer core. This flux leads to a time varying magnetic field that includes a voltage in the output (e.g., secondary) windings of the transformer.

In some cases, the core is so-called "closed-core." An example of closed-core is a "shell form" core. In a shell form, the primary and secondary windings are both wrapped around a central core arm and a both surrounded by outer arms. In some cases, more than one primary winding is provided and multiple secondary windings may also be provided. In such systems, based on the input and to which of the primary windings that input is provided (of course, power could also be provided to more than one primary winding in some instances) different output voltages can be created at each of the secondary windings.

Some power transformers operate at high voltages and/or currents. Such power transformers may produce strong electromagnetic (EM) fields. One approach to deal with the electric fields and parasitic currents they produce is to shield one or both of the primary and secondary windings. This may be especially important where the power transformer operates in high, very-high or ultra-high frequency bands. An example is a power transformer used in a microwave power module.

In some applications, the cost of high frequency and/or high voltage transformers for use in compact equipment can be high relative to the cost of the equipment as a whole or compared to other elements in the equipment. Further, in some cases, the transformer can be difficult to make or prone to failures.

SUMMARY

According to one embodiment a transformer that includes a core having a central arm and first and second outer arms on opposite sides of the of the central arm is disclosed. The transformer includes a first input winding surrounding the central arm, a first output winding surrounding the central arm, a first input winding shield surrounding the first input winding, and a first output winding shield surrounding the first output winding. In this embodiment, the first input winding and the first input winding shield are connected to a steady potential at the input side and the first output winding and the first output winding shield are connected to a steady potential at the output side.

According to another embodiment, a transformer that includes a core having a central arm and first and second outer arms on opposite sides of the of the central arm, a first input winding surrounding the central arm and a first output winding surrounding the central arm is disclosed. The transformer also includes a first input winding shield surrounding the first input winding, the first input winding shield having only flat or arcuate edges in cross section and a first output winding shield surrounding the first output winding, the first output winding shield having only flat or arcuate edges in cross section.

According to another embodiment, a method of forming a transformer is disclosed. The method includes: providing a core; providing a first input winding; proving first output winding; surrounding the first input winding with a first input winding shield, the first input winding shield having only flat or arcuate edges in cross section; surrounding the second input winding with a second input winding shield, the second input winding shield having only flat or arcuate edges in cross section; and disposing the input and output windings around portions of the core.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

As will be described below, a multiple primary and second winding transformer is disclosed. The windings are printed on one or more printed circuit boards (PCBs) and the primary windings are shielded from the secondary windings by surrounding one or both in an outer case that includes a substantially smooth shaped shield disposed therein. As will be become clear below, the shape of the shield may reduce or eliminate discharges due to EM fields near sharp edges typically present in prior art shields.

Figure 1:
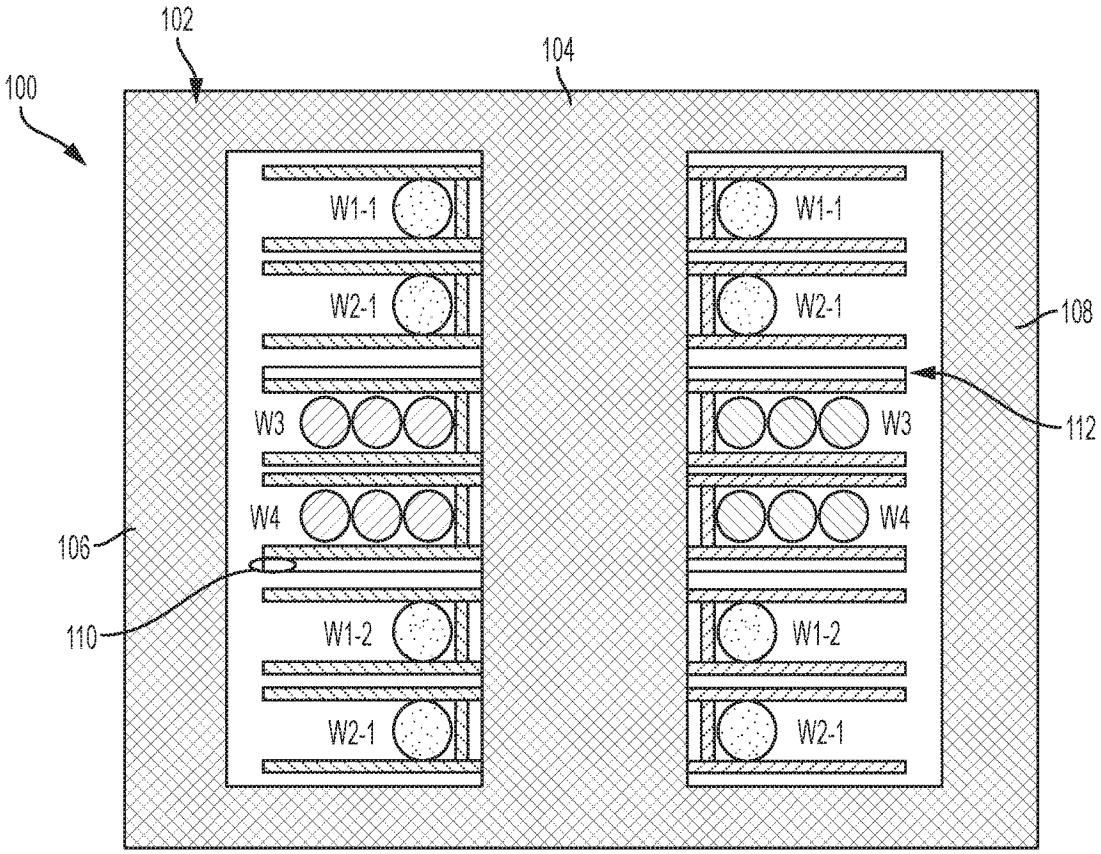
FIG. 1 PRIOR ART
FIG. 1 shows a cross section of a transformer with multiple primary and multiple secondary windings and a shell form core.

FIG. 1 shows an example of a prior art transformer. As illustrated, the transformer 100 includes a core 102. The core 102 may be formed in the prior art and in embodiments disclosed herein by a metal or other magnetically conductive material. Examples includes include ferromagnetic metal such as iron, or ferromagnetic compounds such as ferrites. Other examples include laminated silicon steel. The teachings herein are applied to a core 102 that is of the closed variety and in particular to a shell core having a central arm 104 and outer arms 106, 108.

As illustrated, the transformer 100 includes four primary windings, each having a single turn and are labeled as a first primary winding W1-1, a second primary winding W2-1, a third primary winding W1-2 and a fourth primary winding W2-1. In this and other examples, the primary windings are part of the so-called "low voltage" side of the transformer and each include 1 turn. The illustrated transformer includes two secondary windings W3 and W4 both formed of three turns. In this and other examples, the secondary windings are part of the so-called "high voltage" side of the transformer and each include 3 turns. A low voltage provided to the one or more of the primary winding creates a higher voltage in the secondary windings. Of course, if the number of turns one the primary and secondary could be changes and, accordingly the naming secondary would be low voltage side.

In the example shown in FIG. 1, the primary windings are shielded from the secondary windings W3, W4 by shields 110 and 112. The shields 110, 112 can be an electrostatic shield formed of a conductive metal such a copper. The shields 110, 112 may minimize radiated emissions from secondary-winding high-voltage spikes being transmitted to the primary windings or vice-versa. In some cases, the shield is placed between a transformer's primary and secondary windings to reduce EMI and usually consists of one turn of thin copper foil around the secondary windings. The shield 110 may be coupled to a circuit or system ground that is attached to prevent high-frequency current from coupling.

It has been discovered that sharp edges in a high voltage (HV) region (e.g., near the secondary windings W3, W4) provide locations where partial discharges (coronas) may form. However, foil-based shields and windings made with small diameter wire (in the range of several mils) may create such edges leading to a high-intensity electric field that forms such partial discharges.

Figure 2:
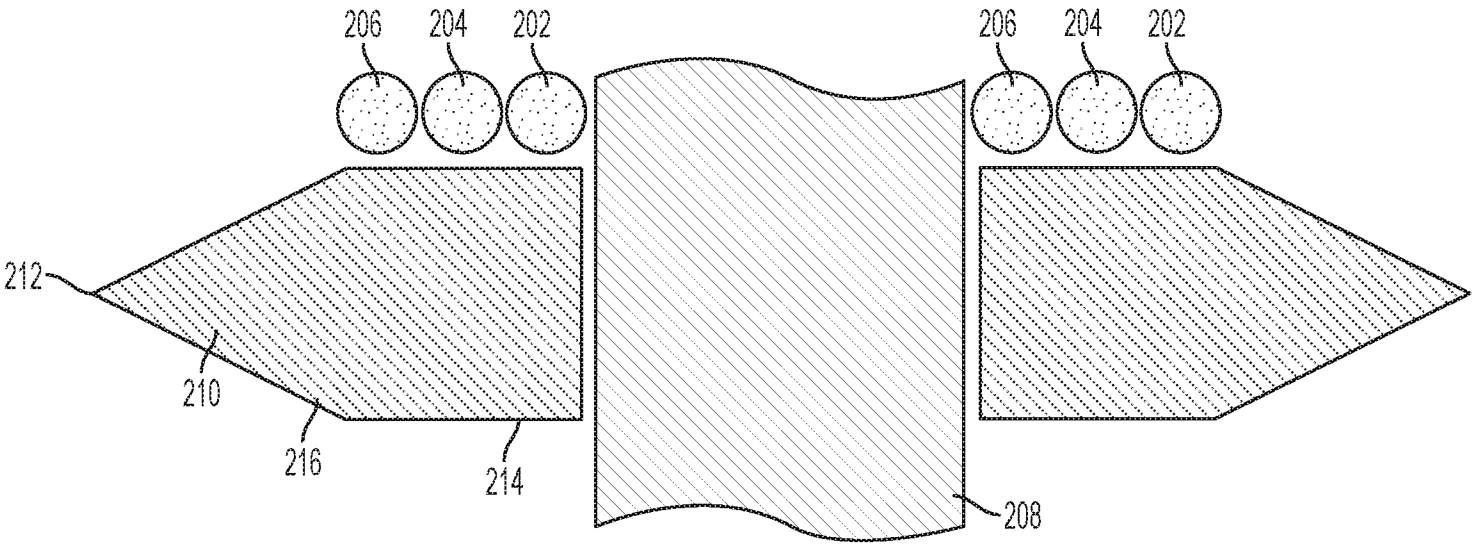
FIG. 2 shows a close up cut-away side view of three coils surrounding a core arm.

For example, FIG. 2 shows a partial cross section of an example shield 210 disposed below three winding turns 202, 204, 206. The windings are wrapped around an arm 208 (e.g., a central arm) of a core. These winding turns 202-206 are shown as being formed of cylindrical wire and are by way of example only. In FIG. 2, an outer edge 212 of the foil shield 210 is one place where discharge may occur while the fields are much lower in smooth regions such a regions 214 and 216. In short, locations where a foil or other shield 210 form a sharp edge can lead to less than desirable results. One approach is to, therefore, not include the shield. However, this may result in the increased interwinding capacitance described above, increased parasitic primary-to-secondary currents and degraded safety. The shield is not the only source of corona because windings made out of fine wire also produce a large electric field gradient.

In some cases high-voltage, high-frequency transformers often use flat, "pan cake" windings to reduce the transformer primary-to-secondary equivalent capacitance. This could lead to a solution where a shield may not be needed. These windings, however, can be labor intensive to use.

Another approach to reduce transformer cost is to form planar windings on a printed circuit board (PCB). However, such windings are not used because winding traces may have sharp edges that further increase electric field intensity issues that are present in foil shields described above.

Figure 3A:
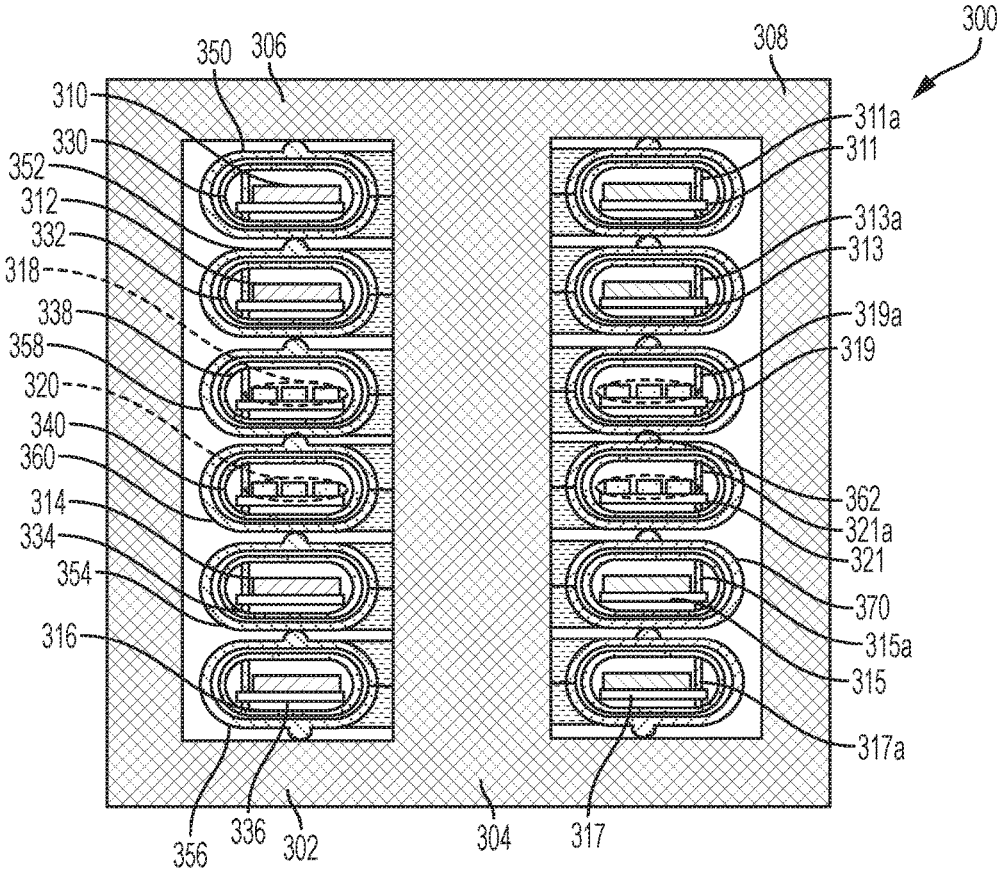
FIGS. 3A, 3B and 3C show, respectively, a cut-away side view of a transformer according to one embodiment formed with square-edged winding traces and a circuit diagram of the transformer of FIG. 3A.

FIG. 3A shows a side view of an example of transformer 300 according to one embodiment. While specific turns ratios and interleaving of primary and secondary windings is shown in FIG. 3A it shall be understood that the teachings herein can be applied to any implementation of a transformer regardless of turns ratios or the exact orientation of the primary and secondary windings.

The transformer 300 includes a core 302. The core 302, as described above, may be formed a metal or other magnetically conductive material. Examples includes include ferromagnetic metal such as iron, or ferromagnetic compounds such as ferrites. Other examples include laminated silicon steel. The illustrated core 302 is of the closed variety, and in particular to a shell core, having a central arm 304 and outer arms 306, 308.

As illustrated, the transformer includes a first pair of primary windings 310, 312 and a second pair of primary windings 314, 316. Each of these windings are illustrated as being formed of a single turn. Of course, the number of and turns of each primary windings may be limited varied as long as one primary winding is provided that has at least one turn. In embodiments herein, one or more of the primary windings 310, 312, 314, 316 are planar windings formed on and supported by a substrate. As illustrated, each winding 310, 312, 314, 316 is formed on and supported by a substrate labeled as 311, 313, 315, 317 formed of a dielectric material.

The transformer 300 also includes secondary windings 318, 320. Each of these windings is illustrated as being formed of three turns. Of course, the number of and turns of each secondary winding 318, 320 may be limited varied as long as one secondary winding is provided that has at least one turn. In embodiments herein, one or more of the secondary windings 318, 320 are planar windings formed on and supported by a substrate. As illustrated, each winding 318, 320 is formed on and supported by a substrate labeled as 319, 321 formed of a dielectric material.

In this manner, one or more of the primary and secondary windings may be formed as part of a printed circuit board. In the prior art using such windings was typically avoided as the traces forming the windings have sharp edges that further increase electric field intensity at those locations and can lead the same or similar problems discussed above with respect to sharp shield edges.

To overcome one or more of the possible problems described above, one or more toroid-shaped shields are provided. As illustrated, each winding 310, 312, 314, 316, 318, 320 is surrounded by a toroid shaped shield. In particular, windings 310, 312, 314, 316, 318, 320 are surrounded by shields 330, 332, 334, 336, 338, 340, respectively. That is, in this embodiment, each winding includes its own shield. In an alternative embodiment, and as shown in FIG. 3C, each pair of primary windings 310, 312 and 314, 316 is within a single primary shield 380, 382, respectively and both secondary windings 318, 320 are within a single secondary shield 384.

Each of the substrates 311, 313, 315, 317, 319 and 321 may be supported within their respective shields by a respective support member 311*a*-321*a*. The support member may be formed of a dielectric or other not conductive material in one embodiment. The support members can be formed at part of the substrate and sided and arranged such that contact a top and bottom surface of the shields to provide a rigid support from which its respective substrate may extend.

In one embodiment, each shield 330, 332, 334, 336, 338, 340 is surrounded by a respective insulting tube 350, 352, 354, 356, 358, 360. (as shown, the tubes are in the form of a hollow toroid) The tube may be formed of any non-conductive material. One or more of the insulating tube 350, 352, 354, 356, 358, 360 may include an optional offset member 362 that provides a means to slightly separate the insulating tubes from one another.

According to one embodiment, one or more of the shields 330, 332, 334, 336, 338, 340 may be shaped such that a portion that is not flat is arcuate. That is, one embodiment, one or more of the shields may be shaped such that, in cross section, they do not have any sharp edges, corners, or discontinuous surfaces. However, as will be discussed below, one or more cuts may be made to the shields but these, while they may introduce a discontinuity at the location of the cut, the cut does not change the shape of the cross-section of the shield. The shields function to change the contour of the HV electric field (e.g., emerging from the flat windings) to reduce its intensity and eliminate ionization.

Figure 3B:
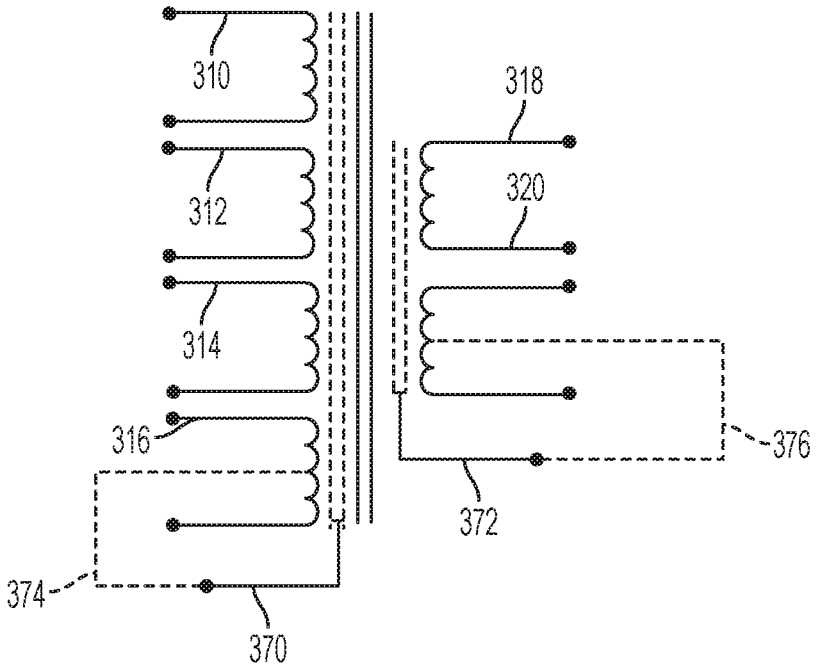
Figure 3C:
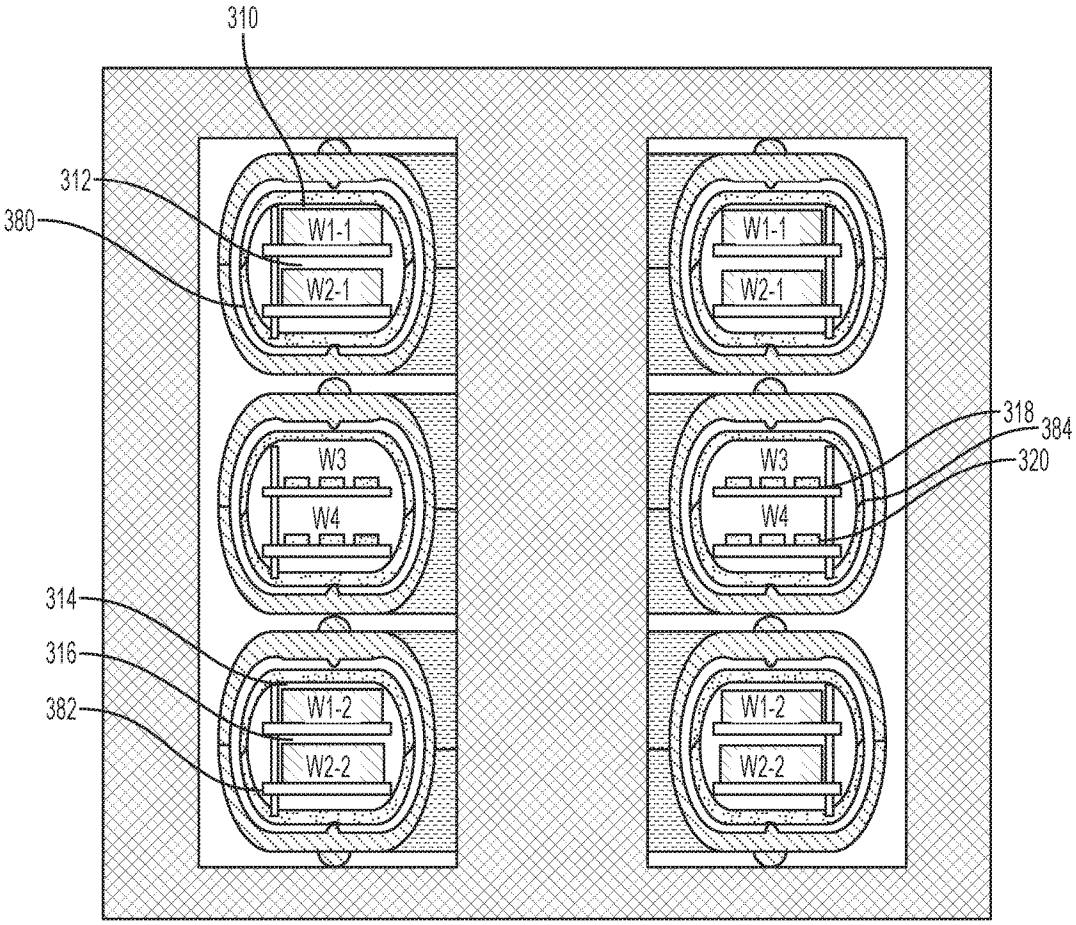

FIG. 3B shows a circuit diagram of the transformer shown in FIG. 3A. In this depiction, the shields are divided into primary and secondary shields 370, 372. In one embodiment, the primary shield 370 in actually the electrical equivalent of shields 330, 332, 334, 336 and the secondary shield 372 is the electrical equivalent of shields 338 and 340. The primary shield 352 is connected to a steady potential at the primary side and the secondary shield is connected to a potential on the secondary side. Examples of a steady potential include a center tap of the transformer winding (see optional connections 374, 376), a neutral point (if a three-phase transformer with star connection of windings is used) or any DC potential available in the power converter using this transformer. In one embodiment, the DC voltages help maintain a minimum voltage difference between the shields and the enclosed windings.

Figure 4:
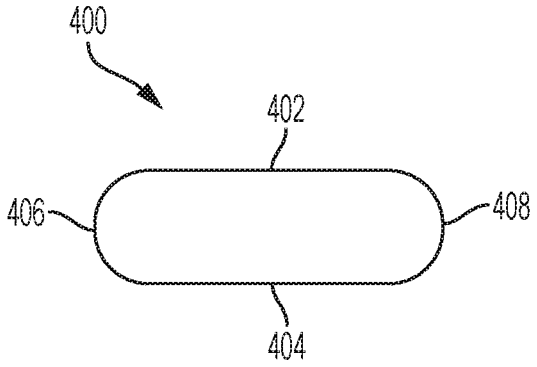
FIG. 4 shows a cross section on an example of shield according to one embodiment.

With reference now to FIG. 4 a cross-section of an example shield 400 is shown. As illustrated the shield is toroidal in shape and includes opposing flat surfaces 402, 404 connected by arcuate inner 406 and outer 408 connectors. Of course, the exact shape could be varied.

Figure 5A:
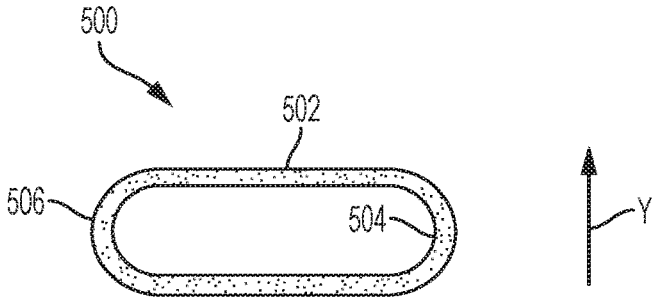
FIGS. 5A and 5B shows a cross section and a top view of an embodiment of a shield according to one embodiment.
Figure 5B:
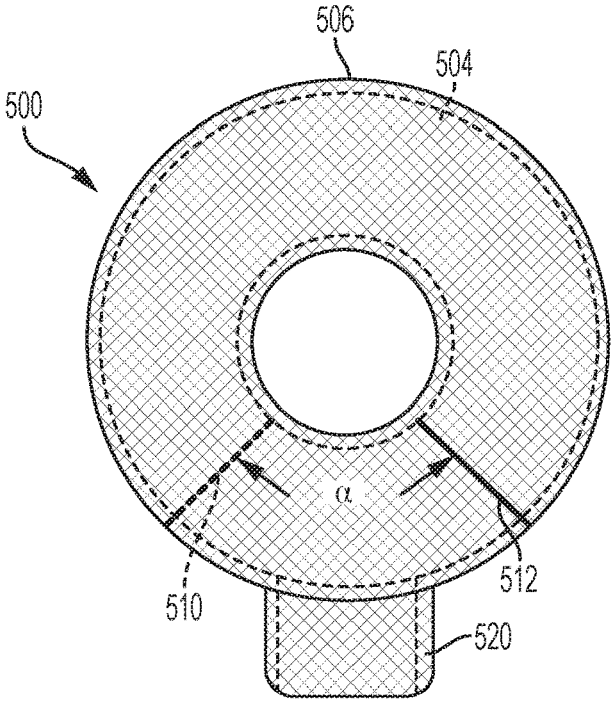

To avoid shorting the transformer, the shield 400 has to have a single cut formed therein. This is due to the fact that if a shield forms a continuous loop around the center leg of the core, it will act as a shorted turn of the winding and, in effect, short circuit the transformer. However, the location of the cut may create edges leading to high intensity field in its immediate vicinity bringing back the initial corona problem discussed above. To address this situation, and as shown in FIGS. 5A and 5B, a shield 500 may be formed such that it includes a core section 502 formed of a dielectric material. Inner and outer surfaces of the core section 502 are coated with inner and outer metallic layers 504, 506. As these layers do not conduct significant current, the metallic layers 504, 506 may be formed by any method of metallic deposition. With reference to FIG. 3B, it shall be understood that both inner and outer metallic layers 504, 506 may be connected to the same voltage (e.g., combined they form a shield and a connected to either the primary side DC voltage or the secondary side DC voltage depending on whether the winding it is shielding is on the primary or secondary side.

In FIG. 5B the cuts described above are shown as cut 510 in the inner metallic layer 504 and cut 512 in outer metallic layer 506. They may be formed vertically (e.g., in direction Y shown in FIG. 5A). In FIG. 5B the inner metallic layer 504 is shown by dashed lines as it is not visible from a top view of the shield 500. In one embodiment, the vertical cut in each layer 504, 506 is separated by an angle a that is greater than approximately 18 degrees. As the two metallic layers 504, 506 are closely spaced, their composite electric field may have low intensity.

FIG. 5B also shows a turn entrance 520 through which power may be provided to our drawn from the windings in the shield 500. In one embodiment, turn entrances for primary windings are on one side of the transformer and a turn entrance for the secondary windings is on the other.

Figure 6:
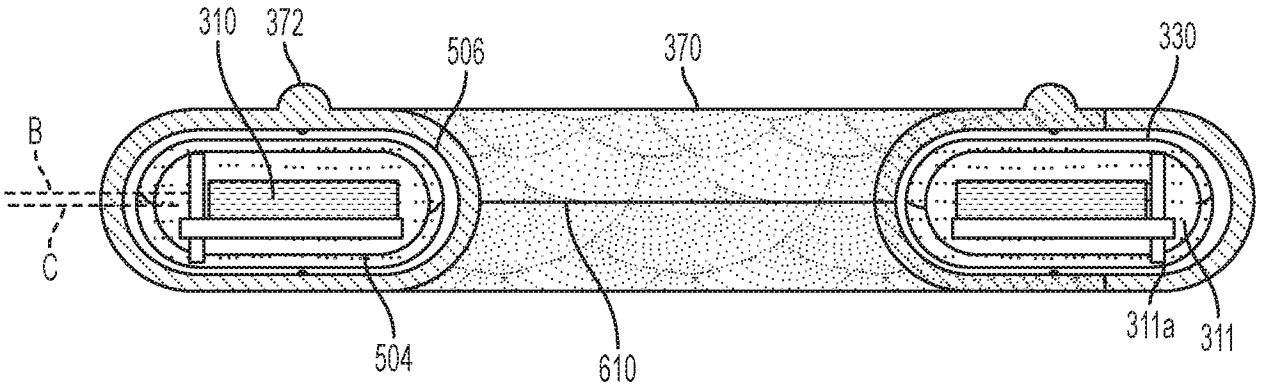
FIG. 6 shows a cross section of a one coil, a shield and an outer casing.

With reference to FIG. 6, which shows an example shield 330 surrounded by an outer casing 370. In this example, a single turn winding 310 is illustrated but the teachings could be applied to any number of turns. The winding 310 may be formed as one or more planar PCB traces in one embodiment. As discussed above, such windings may lead to coronas in the prior art as they have sharp edges. However, as disclosed herein, the shield 330 is at the same or near voltage to the traces and this reduces or eliminates high voltage differences between the edges and the adjacent windings or between windings and the core.

In order to place the windings 310, and support structures 311, 311*a* in the shield 330 and outer casing 370, both the shield 330 and outer casing 370 are cut. In particular, outer casing 370 is cut along cut line 610.

The shield 330 in this embodiment, includes an inner and outer metallic layers 504, 506. To ensure that the cut of the shield 330 does not create high intensity field in its immediate vicinity (identical to the previous problem regarding the vertical cut in the shield 330), the cuts in the inner and outer metallic layers 504, 506 are displaced into different horizontal planes B and C. As the inner and outer metallic layers 504, 506 are closely spaced, their composite electric field has a low intensity and does not lead to the problems discussed above.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof The corresponding structures, materials, acts and equivalents of all means or step plus function elements in the claims below are intended to include any structure, material or act for performing the function in combination with other claimed elements as claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

While embodiments have been described, it will be understood that those skilled in the art, both now and in the future, may make various improvements and enhancements which fall within the scope of the claims which follow. These claims should be construed to maintain the proper protection for the invention first described.

What is claimed is:

1. A transformer comprising:

a core having a central arm and first and second outer arms on opposite sides of the of the central arm;

a first input winding surrounding the central arm;

a first output winding surrounding the central arm;

a first input winding shield;

a first output winding shield surrounding the first output winding and separating the first output winding from the first input winding shield;

wherein the first input winding and the first input winding shield are connected to a steady potential at the input side and the first output winding and the first output winding shield are connected to a steady potential at the output side;

wherein the first input winding shield is formed by a hollow toroid shaped dielectric having inner and outer metallic layers, the inner metallic layer disposed inside and contacting the hollow toroid shaped dielectric and the outer metallic layer on disposed outside and contacting the hollow toroid shaped dielectric; and wherein the first input winding is surrounded by the inner metallic layer of the first input winding shield.

2. The transformer of claim 1, wherein the input winding includes at least one turn and is formed on a circuit board.

3. The transformer of claim 2, wherein the input winding has at least corner edge.

4. The transformer of claim 3, wherein the output winding includes at least one turn and is formed on a circuit board and has at least corner edge.

5. The transformer of claim 1, wherein the inner and outer metallic layers are both vertically cut to form an inner metallic layer shield cut and an outer metallic layer shield cut.

6. The transformer of claim 5, wherein the inner metallic layer shield cut and the outer metallic layer shield cut are separated by an angle ($\alpha$) measured from a center point of the first input winding shield.

7. The transformer of claim 1, wherein the inner and outer metallic layers are cut such the outer metallic layer is cut at a vertically different level than the inner metallic layer.

8. The transformer of claim 1, further comprising:

an insulating outer casing surrounding one of the input winding shield and the output winding shield.

9. The transformer of claim 1, wherein the first input winding shield has only flat or arcuate edges in cross section and the first output winding shield has only flat or arcuate edges in cross section.

10. The transformer of claim 1, further comprising:

a second input winding surrounding the central arm;

a second output winding surrounding the central arm;

a second input winding shield surrounding the second input winding, the second input winding shield having only flat or arcuate edges in cross section; and a second output winding shield surrounding the second output winding, the second output winding shield having only flat or arcuate edges in cross-section;

wherein the second input winding and the second input winding shield are connected to a steady potential on the input side and the second output winding and the second output winding shield are connected to a steady potential at the output side.

11. A transformer comprising:

a core having a central arm and first and second outer arms on opposite sides of the of the central arm;

a first input winding surrounding the central arm;

a first output winding surrounding the central arm;

a first input winding shield having only flat or arcuate edges in cross section;

a first output winding shield surrounding the first output winding, the first output winding shield having only flat or arcuate edges in cross section and separating the first output winding from the first input winding shield;

wherein the first input winding shield is formed by a hollow toroid shaped dielectric having inner and outer metallic layers, the inner metallic layer inside and contacting the hollow toroid shaped dielectric and the outer metallic layer outside and contacting the hollow toroid shaped dielectric; and wherein the first input winding is surrounded by the inner metallic layer of the first input winding shield.

12. The transformer of claim 11, wherein the input winding includes at least one turn and is formed on a circuit board and has at least corner edge.

13. The transformer of claim 12, wherein the output winding includes at least one turn and is formed on a circuit board and has at least corner edge.

14. The transformer of claim 11, wherein the inner and outer metallic layers are both vertically cut to form an inner metallic layer shield cut and an outer metallic layer shield cut.

15. The transformer of claim 14, wherein the inner metallic layer shield cut and the outer metallic layer shield cut are separated by an angle ($\alpha$) measured from a center point of the first input winding shield.

16. The transformer of claim 11, wherein the inner and outer metallic layers are cut such the outer metallic layer is cut at a vertically different level than the inner metallic layer.

17. The transformer of claim 11, further comprising:

an insulating outer casing surrounding one of the input winding shield and the output winding shield.

18. The transformer of claim 11, wherein the first input winding and the first input winding shield are connected to a steady potential on the input side and the first output winding and the first output winding shield are connected to a steady potential on the output side.

19. The transformer of claim 11, further comprising:

a second input winding surrounding the central arm;

a second output winding surrounding the central arm;

a second input winding shield surrounding the second input winding, the second input winding shield having only flat or arcuate edges in cross section; and a second output winding shield surrounding the second output winding, the second output winding shield having only flat or arcuate edges in cross-section;

wherein the second input winding and the second input winding shield are connected to a steady potential on the input side and the second output winding and the second output winding shield are connected to a steady potential on the output side.

20. A method of forming a transformer comprising:

providing a core;

providing a first input winding;

providing a first output winding;

providing a first input winding shield, the first input winding shield having only flat or arcuate edges in cross section;

surrounding the first output winding with a first output winding shield, the first output winding shield having only flat or arcuate edges in cross section;

disposing the input and output windings around portions of the core;

wherein the first output winding is separated from the first input winding shield by the first output winding shield;

wherein the first input winding shield is formed by a hollow toroid shaped dielectric having inner and outer metallic layers, the inner metallic layer inside and contacting the hollow toroid shaped dielectric and the outer metallic layer outside and contacting the hollow toroid shaped dielectric; and wherein the first input winding is surrounded by the inner metallic layer of the first input winding shield.

21. The method of claim 20, wherein the first input winding shield is formed by a toroid shaped dielectric having inner and outer metallic layers formed on inner and outer surfaces of the first input winding shield.

22. The method of claim 21, wherein the inner and outer metallic layers are both vertically cut to form an inner metallic layer shield cut and an outer metallic layer shield cut.

23. The method of claim 22, wherein the inner metallic layer shield cut and the outer metallic layer shield cut are separated by an angle ($\alpha$) measured from a center point of the first input winding shield.

* * * * *